US005650037A

United States Patent [19]

Larson

[11] Patent Number: 5,650,037

[45] Date of Patent: Jul. 22, 1997

[54] THERMAL INK TRANSFER DECORATING APPARATUS

[75] Inventor: Mark G. Larson, Milwaukee, Wis.

[73] Assignee: Krones, Inc., Franklin, Wis.

[21] Appl. No.: 543,035

[22] Filed: Oct. 13, 1995

[51] Int. Cl.[6] ..... B44C 1/165; B65C 9/04; B65C 9/18; B65C 9/30

[52] U.S. Cl. ..... 156/540; 156/542; 156/566; 156/567

[58] Field of Search ..... 156/362, 447, 156/449, 456, 540, 542, 566, 567

[56] References Cited

U.S. PATENT DOCUMENTS

| | | | |
|---|---|---|---|
| 3,861,986 | 1/1975 | Wochner | 156/542 |
| 4,239,569 | 12/1980 | Harvey | 156/156 |
| 4,253,904 | 3/1981 | Jodrey et al. | 156/497 |
| 4,735,664 | 4/1988 | Asghar et al. | 156/64 |
| 4,909,888 | 3/1990 | Kobayashi et al. | 156/361 |
| 4,992,129 | 2/1991 | Sasaki et al. | 156/240 |
| 5,028,293 | 7/1991 | Harvey | 156/449 |
| 5,188,696 | 2/1993 | Good, Jr. | 156/361 |
| 5,250,129 | 10/1993 | Twele | 156/64 |

FOREIGN PATENT DOCUMENTS

| | | | |
|---|---|---|---|
| WO94/05515 | 3/1994 | WIPO | B44C 1/165 |

*Primary Examiner*—James Engel
*Assistant Examiner*—J. A. Lorengo
*Attorney, Agent, or Firm*—Ryan, Maki, Mann & Hohenfeldt, S.C.

[57] ABSTRACT

In a thermal ink transfer machine, the web is drawn translationally through a station at which thermal ink graphics are transferred from the web to the periphery of a container such as a glass or plastic bottle or can. Transfer of the graphics is effected with a transfer head or cylinder which has arranged about its axis of rotation a plurality of equally spaced apart radially spring biased rollers. When the longitudinally extending graphics on the web enters the transfer station, the spring biased rollers yield radially inwardly and outwardly to press against the backside of the web to effect transfer of the graphics. The apparatus has the rotating transfer head on one side of the web and the containers carried on a turntable on the opposite side of the web. The transfer head rotates in a particular direction around its vertical axis and drives the rollers orbitally toward and away from the graphics transfer station. The containers are supported on rotationally driven disks that are equally spaced apart on the turntable and bring the periphery of the containers into alignment with one of the spring biased rollers when graphics transfer is initiated where the leading end of the graphics make first contact with the container. The containers rotate in a direction opposite from the direction in which the turntable rotates. Thus the periphery of a container when in the transfer station moves in the same direction as the web. Means are provided for feeding web from an unwind reel to the transfer station and from the transfer station to a rewind reel. Means are also provided for maintaining equality in the length of web extending from the unwind reel to the transfer station and from the transfer station to the rewind reel. Means are also provided for maintaining constant tension in the web.

4 Claims, 15 Drawing Sheets

THERMAL INK TRANSFER DECORATING APPARATUS

BACKGROUND OF THE INVENTION

The invention disclosed herein pertains to a machine for transferring graphical and decorative images from a moving web to moving articles such as containers including plastic and glass bottles and metal cans.

Machines for transferring graphics and decorative images printed in the negative or reverse form on a web with heat transferable ink are basically known. The ink images on the web, whether for decorating a container or for providing graphical information will be characterized herein selectively as "graphics". The transfer process will be characterized as "decorating" for the sake of brevity. For optimized graphics transfer of an image from the web to a container it is usually necessary to heat the container and the web before the web is pressed against the container to transfer the graphics at a transfer station. The web is coated with a release agent which assures that no trace of the ink will remain on the web after thermal transfer.

Containers that are to be decorated are conveyed linearly uniformly spaced apart and rotated about their own axes as they pass the transfer station and are transported on a turntable so the containers arrive at the transfer station in phase with graphics on the web.

Existing thermal ink graphics transfer machines have been found to be disadvantageous because they must be run at unacceptably low speeds in order to obtain reasonably accurate positioning and appearance of the decoration on the containers. These machines are not suitable for use in a production line with other apparatus that may process containers that are fed to the thermal transferring machine at rates of five or more times the rate at which the existing machines can be operated. Precise positioning of graphics on a bottle or can is especially important where a graphics label or decoration is to be applied to the front of bottles or cans and other decorations are to be applied to the backs of the bottles or cans. In such cases the decoration or labeling on the front and back of the container must be diametrically opposite of each other. For prior thermal ink transfer decorating machines to be widely acceptable it would be necessary for the machines to decorate containers at speeds of five hundred containers or more per minute. Insofar as applicant is able to ascertain, speeds of this magnitude have never been achieved before the invention to be described herein was made.

It is elementary that any thermal ink graphics transferring machine must unwind a roll of web bearing uniformly spaced apart graphics. Various satisfactory wind and unwind systems are available since they have been used for a long time in other labeling machines. The technology for maintaining proper web feed rates and tension is also known. Designers of web handling or transporting apparatus have been reasonably successful in achieving low inertia web handling systems so the web can be accelerated and decelerated rapidly to correct for positional errors between the graphics and place where the moving web and graphics ought to be relative to each other when graphics transfer occurs. If the inertia within the web handling system is high, there is an increased probability of the web being stretched or broken when it is being accelerated.

One of the reasons why the output of decorated containers from existing graphics transfer machines has been less than optimum results from designers failing, before the invention disclosed herein was made, to realize or understand what the relationship should be between the speed and direction of the web, the rotational speed and rotational direction of the container and the translational direction of the container.

SUMMARY OF THE INVENTION

In the machine described herein, articles including containers such as plastic and glass bottles and cans are transferred in succession and in upright orientation to support disks that are continuously rotating and are arranged in a circle about a turntable. Coincident with arrival of a container on a support disk, a "centering bell" for each container is driven downwardly to engage the top of the container and stabilize it. Shortly thereafter, the support disk starts to rotate at a substantial speed about its vertical axis. The turntable is turning about its vertical axis and the container is turning about its vertical axis as the container is being translated in a circular path by the turntable. A rotatable thermal ink graphics transfer head is arranged along the circular path with its periphery proximate to the peripheries of the passing containers with the web interposed or being translated between the head and the containers. The rotational axis of the transfer head is parallel to the rotational axis of the turntable when the graphics are transferred to a regular upright cylindrical region of a container. The transfer head has radially biased equiangularily spaced apart rollers at its periphery. The web translates in contact with the periphery of the container and the web moves between the transfer head and the periphery so the rollers on the transfer head press against the bare back face of the web and roll the thermal ink graphics onto the rotating container.

According to the invention, the theoretical and actual maximum output of a thermal ink graphics transfer machine is obtained by having the transfer head on one side of the web and the turntable on the other side of the web such that their linear or tangential components of rotation point in the same direction and the transfer head and turntable rotate about vertical axes in opposite directions. The web is translated in either direction of the tangential components of the rotating head and the turntable. The containers on the turntable are on individual rotatingly driven disk supports for the peripheries of the containers to move in the same direction as the web translates but in either direction of the rotational direction of the turntable. Stated in another way, the containers rotate in a direction opposite of the direction in which the containers travel or translate and the web translates in the peripheral direction of the container.

For the most part, the machine uses conventional parts and methods for maintaining equality in the tension and quantity of web leading from the web unwind reel to the graphics transfer station and from the transfer station to the bare web rewind roll. Web equality is accomplished by utilizing a shuttle in conjunction with metering rolls. The shuttle signals a programmable controller when inequality exists and the controller controls the metering rolls to run at a rate that reestablishes equality.

A photodetector senses registration marks on the web in a traditional way. The marks are indicative of the location on the web of the leading edge of the graphics. Any error between where the graphics are located relative to the machine or container position is corrected quickly with a capstan motor that drives rollers that pinch the web near the transfer station and either accelerate or decelerate the web to assure that the leading end of the graphics will first touch the container exactly on the container where graphics transfer should begin.

How the rotational directions of the turntable, the containers, the transfer head, the direction of the linear components of rotation, and the direction of web travel relative to the transfer edge, turntable and containers are implemented will be evident in the more detailed description of a preferred embodiment of the invention which will now be set forth in reference to the accompanying drawings.

DESCRIPTION OF A PREFERRED EMBODIMENT

Figure 1:
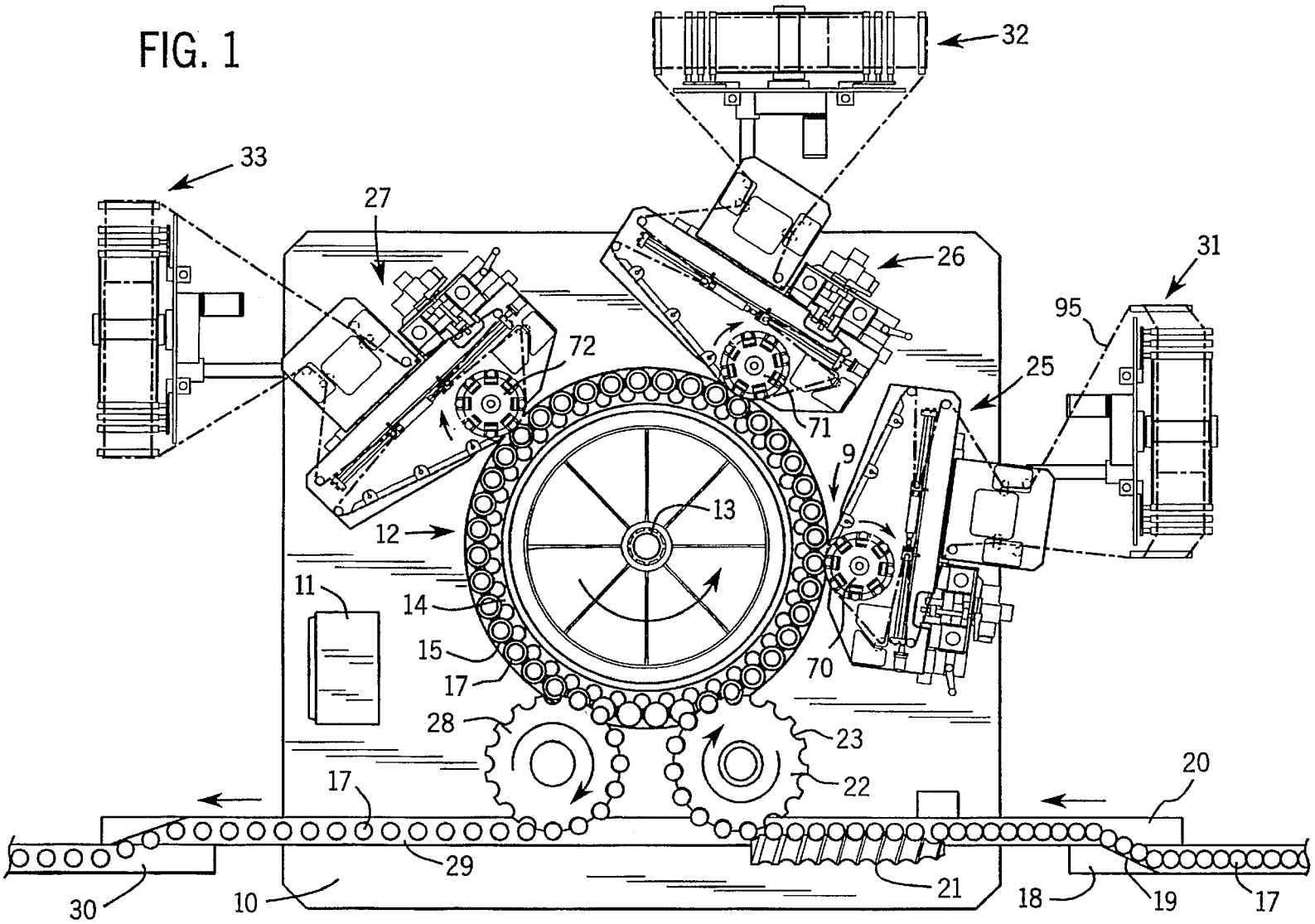
FIG. 1 is a top plan view of a thermal ink graphics transfer machine which has three separate graphics transferring or container decorating heads which can label or decorate the front, back and neck of a container during one pass through the machine.

The general characteristics of the thermal ink transfer machine will be outlined in reference to FIG. 1. The machine is comprised of a base 10. Operator interface with the machine is accomplished with a computer station 11 which is symbolized by a rectangle and includes a programmable logic controller (PLC). A turntable, generally designated by the numeral 12, is driven rotationally about a vertical axis on a shaft 13. The turntable 12 has a circular rim 14 on which are mounted for rotation about their vertical axes a plurality of container support disks 15 which are spaced apart equiangularily on rim 14. By way of example and not limitation, there are forty rotationally driven disks in the illustrated machine. As will be explained in more detail later, each disk 15 receives a container such as 17, such as a plastic or glass bottle or metal can, that is fed into the machine for being decorated by the thermal ink transfer method. Also to be discussed in more detail later is how a centering bell, not shown in FIG. 1, comes down on the open mouth of a container 17, such as a bottle or can or any other suitable article, to stabilize the container as it is rotated about its vertical axis by rotating container support disk 15 while the container 17 is being translated reversely by turntable 12.

Containers that are to be decorated or labeled, as the case may be, are supplied to the machine by an infeed belt conveyor 18 on which the containers 17 have little, if any, space between them. A deflector 19 directs incoming containers 17 from infeed conveyor 18 to another conveyor 20 which is translating slower than conveyor 18 so the containers become back-to-back on conveyor 20. This is conventional. The pitch of the infeed worm 21 is the same as the pitch of the pockets 23 in an infeed starwheel 22 which is driven for rotating about a vertical axis at a constant speed in phase relationship with turntable 12. As containers 17 are moving along on conveyor 20, they are captured by the infeed worm 21 and advanced into pockets 23 of infeed starwheel 22. The starwheel moves the containers and deposits them successively and correctly synchronized on rotatable container support disks 15 that orbit with turntable 12. When an incoming container 17 is released from infeed starwheel 22 to the turntable 12, the container is engaged at its mouth end by a centering bell, not shown in FIG. 1, for the container to be ready for being rotated as it orbits.

After the containers 17 on the turntable 12 are decorated, at one or more of the decorating stations in units 25, 26 and 27, the containers are transferred consecutively from turntable 12 to an outfeed starwheel 28. The starwheel 28 discharges the decorated containers to linear outfeed conveyors 29 and 30 in the stated order.

Substantially all of the structure thus far described except the briefly mentioned decorating units, 25, 26 and 27 is conventional.

The center-to-center or axis-to-axis distance between adjacent rotating container support disks 15 and the containers thereon is characterized as the "machine pitch". An encoder, not shown, makes one revolution per machine pitch. Counting means in the programmable controller count continuously at the rate of 1,000 counts per machine pitch, for example. The beginning of a 1,000 count series is marked by the encoder signaling the machine position. Thus, in a sense, the programmable controller knows where the machine is at all times to within one part in 1,000 so that the leading edge of the graphics on the web can be made to make first contact with the container very accurately in respect to the place on the container where the graphics deposition should be started. The rate at which the bottle rotates depends upon a number of factors including machine pitch relative to the diameter of the container. By way of example and not limitation, in an actual embodiment of the machine, beverage bottles, for example, are rotated at approximately two revolutions per pitch as they are transported by the turntable and as they are being decorated.

In FIG. 1, one may see that each one of the decorating units 25, 26, and 27 has affiliated with it web unwind and rewind systems 31, 32 and 33. These systems are well known but will be discussed in a little more detail later.

Figure 2:
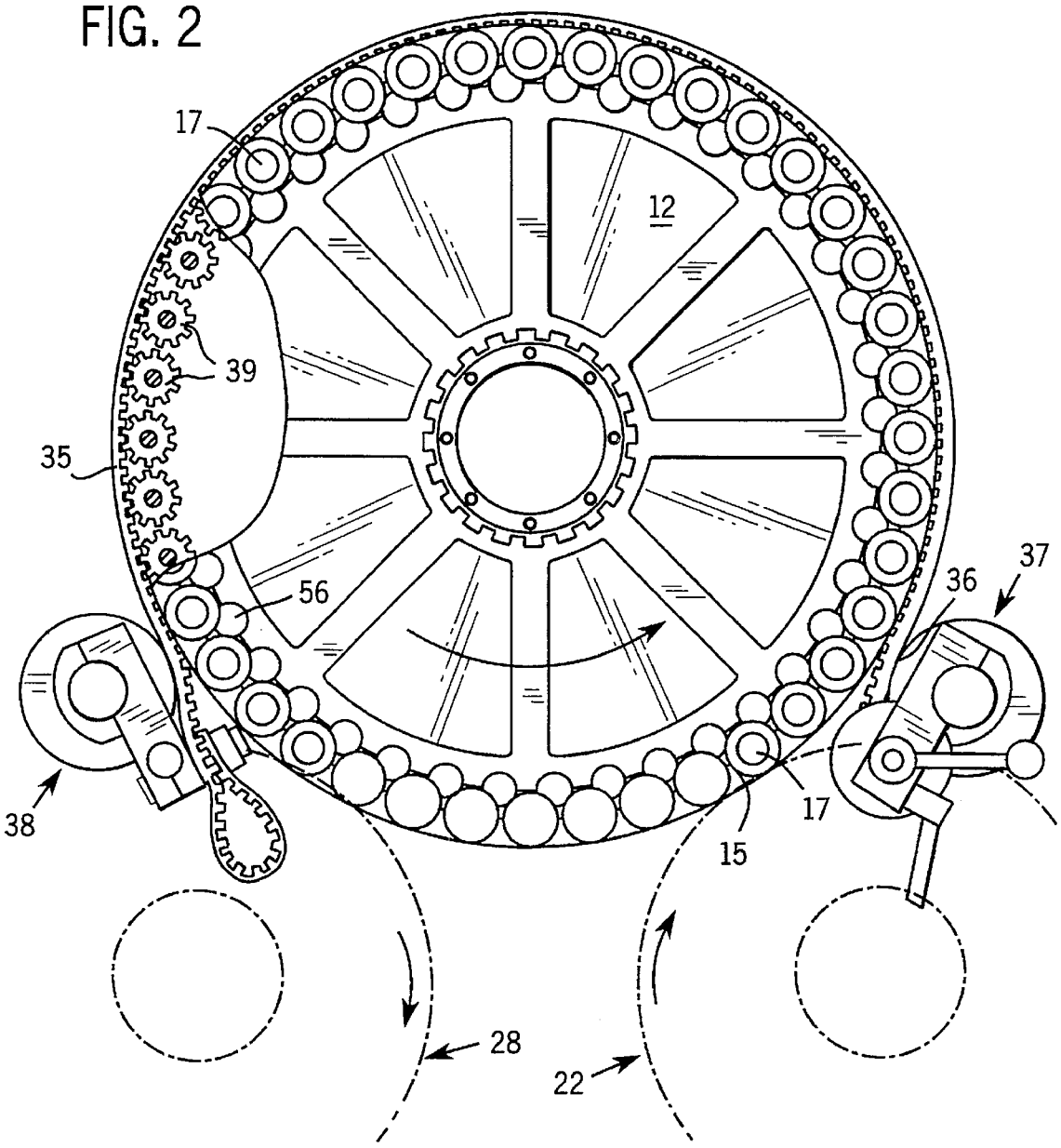
FIG. 2 is a top plan view of the turntable used in the machine showing how toothed wheels which are arranged in a circle engage a stationary toothed belt so as to impart rotation to the wheels and the bottle support disks that are carried by the wheels in response to turntable rotation.

Part of the drive system for the rotatable container support disks 15 on turntable 12 is shown in the plan view of FIG. 2. At a level slightly below the turntable 12 the latter is surrounded over the majority of its circumference by a stationary toothed belt 35. One end 36 of the belt is anchored in a belt anchoring and tensioning mechanism 37 and the other end is fastened in a belt anchoring mechanism 38. The smaller circles 56 in FIG. 2 are the circular tops of bearing capsules which appear in side elevation in FIGS. 6 and 7, for example. Skilled designers will perceive that the toothed belt 35 can be anchored and tensioned in various ways so that elaboration of this matter is not necessary. It is sufficient to observe that the gears 39 are rotated by engaging the belt and that the containers rotate on support disks 15 at the rate of gears 39 while the containers are translated by the turntable 12.

Figure 6:
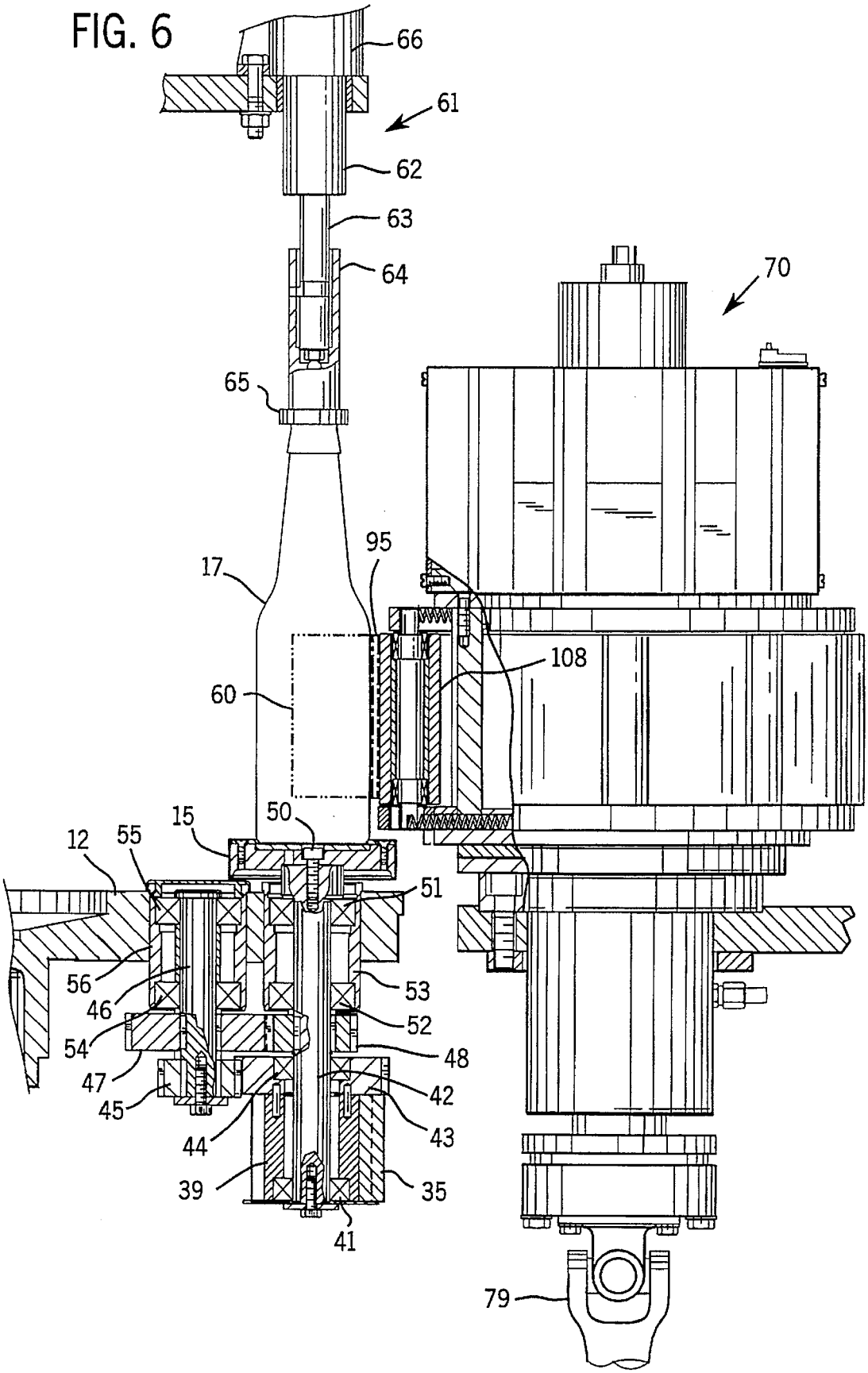
FIG. 6 is a side elevational view, partly in section, of the transfer head in conjunction with the toothed belt driven gear train used to rotate a container support disks that are driven rotationally as the disk orbits with a bottle on it.
Figure 7:
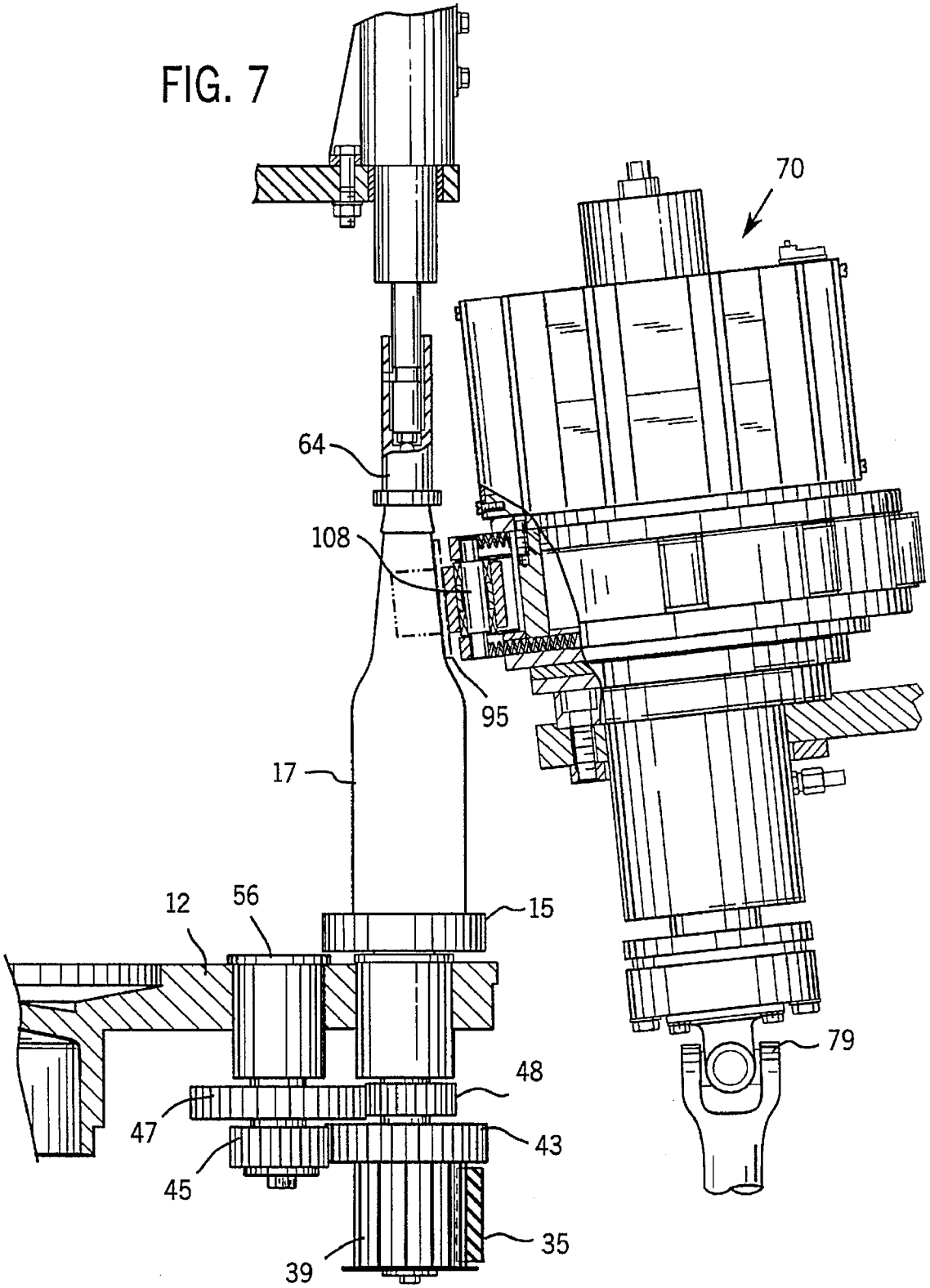
FIG. 7 is mostly like FIG. 6 except that the transfer head axis is now tilted away from vertical to facilitate transferring graphics to the tapered neck of a bottle.

As shown in FIGS. 2, 6, and 7, the teeth of belt 35 mesh with toothed wheels 39 which rotate freely on shaft 42. A bearing 41 on rotatable shaft 42 permits gear 39 to rotate on it. A gear 43 is pinned to wheel 39 for the two to rotate together freely on shaft 42. Gear 43 has a bearing 44 fitted on shaft 42. Gear 43 meshes with a pinion 45 which is keyed to a rotatable shaft 46. Another gear 47 is keyed to rotatable shaft 46 and meshes with a pinion 48 that is keyed to shaft 42 for rotating shaft 42 and, hence, rotating container support disk 15 which is fastened to shaft 42 with a machine screw 50. Shaft 42 is mounted for rotation with two bearings which are fixed in a cylindrical member 53 and are fixed in turntable 12. Shaft 46 is rotatable by means of two bearings 54 and 55 whose outer races are fixed in cylindrical member 56 whose top circular surface shows in FIG. 2. In FIGS. 6 and 7, a container in the form of a bottle 17 is rotating with container support disk 15. Part of a front thermal transfer label that is presently being applied to container 17 is outlined with dash-dot lines.

The gear train just described is for stepping up the rotational speed of the support disks and containers thereon about their vertical axes relative to the turntable rotational speed. Because of the relationship mentioned earlier between the rotational and translational directions of the turntable, transfer head, bottle supports and web, unusually high rotational speeds for the disks and bottles can be used to maximize productivity of the machine.

FIG. 6 also shows the working part of a container centering and stabilizing assembly designated generally by the numeral 61. The assembly and its function are well known to designers of labeling machines and the like. A container 17 rotating at high speed and orbiting at the same time with the turntable must be prevented from falling off its support disk 15. Thus, when a container is being released by infeed starwheel 22 to a container support disk 15 on turntable 12, a conventional cam activated spring loaded cylinder 66 drives a ram 62 downwardly. The ram has a stem 63 to which a coupler, usually called a centering bell 64, is attached. The lower end 65 of the centering bell is configured for engaging a mouth of a container 17. The ram 62 is journaled for rotation in cylinder 66.

Figure 3:
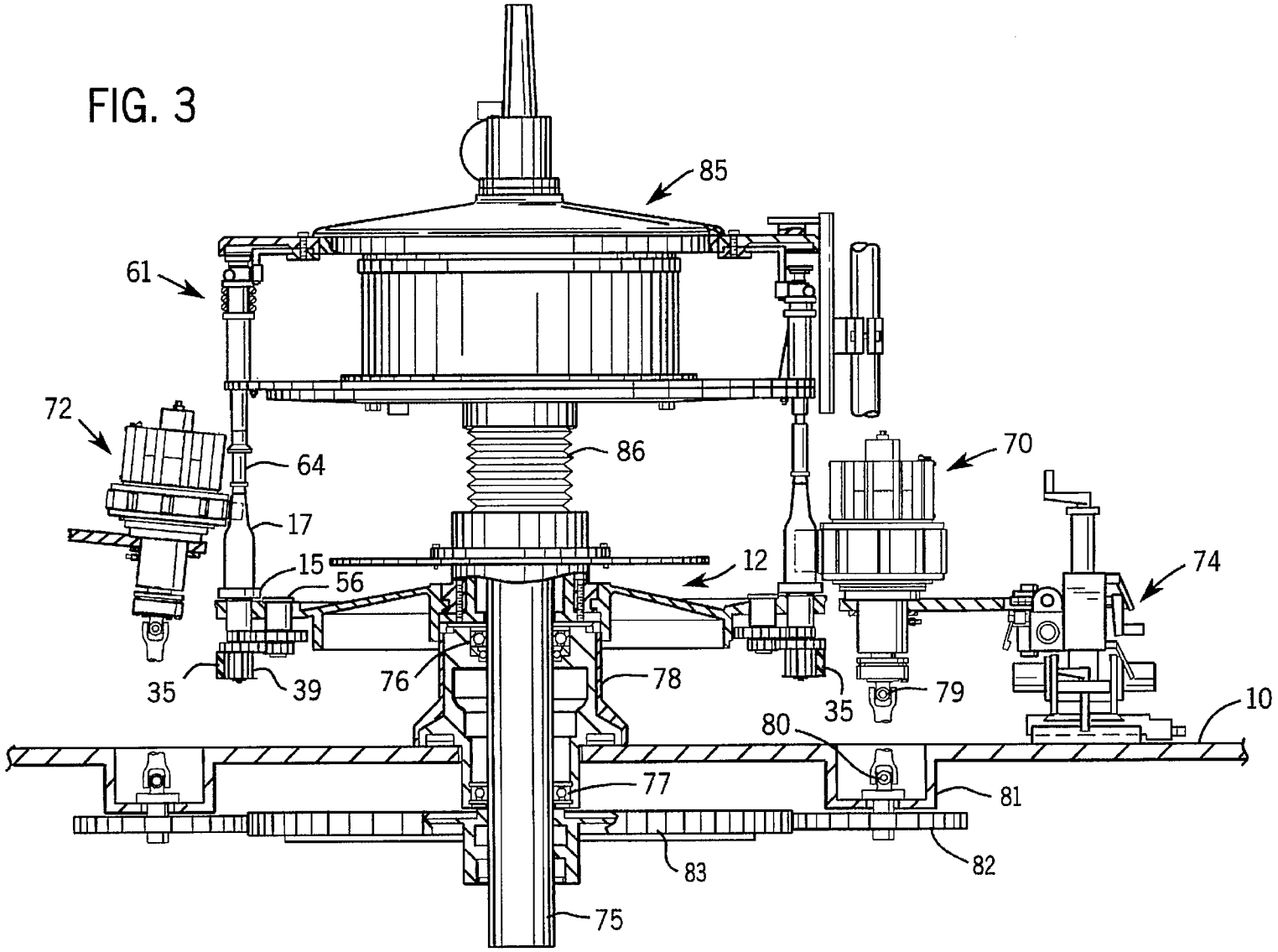
FIG. 3 is a side elevational view of the turntable and the other associated parts of the machine.

FIG. 6 also shows a side elevational view of a typical one of the thermal ink transfer heads or cylinders which will be returned to for discussion later. One may observe at this time that the axis of the transfer head is vertical in FIG. 6 which is appropriate for transferring thermal ink graphics from a web 95 to the front or diametrically oppositely to the back of the cylindrical body of a container such as a bottle. In FIG. 7, on the other hand, the transfer head is tilted to provide for applying graphics to a tapered surface of revolution such as the neck of a bottle 17. FIG. 3 shows a general or summary arrangement of some parts of the machine involved in orbiting and concurrently rotating containers. Most of the parts are conventional except for the two of three transfer heads 70 and 72 which are illustrated. The mechanisms 72 and 74, for raising and lowering the transfer heads to permit decorating containers of various heights and for moving the transfer heads radially inwardly and outwardly to permit decorating containers of various diameters, has also been used in labeling machines before. FIG. 3 shows that the turntable 12 is driven rotationally by a driven shaft 75 that is coupled to the main drive system, not shown, of the machine. The shaft is provided with bearings 76 and 77 for rotating in a housing 78. The typical transfer heads 70 and 71 are driven by shafts which interconnect with upper and lower universal joints 79 and 80. Typical universal joint 80 is in a housing 81 which is mounted to a gear 82 for rotating with the gear. Gear 82 is driven by a gear 83 which turns with shaft 75. The toothed wheels 39 that are driven by running along stationary toothed belt 35 are also shown. The structure 85 which supports the pressurized air lines and so forth for actuating centering bell assemblies 61 can be raised and lowered to adjust for containers 17 of various heights. When shaft 75 is driven rotationally about its vertical axis, the container supports 15 rotate and orbit concentrically on the turntable 12 around shaft 75. This shaft is actually hollow for bringing up tubing and wiring, not shown, as is a known practice. A bellows cuff 86 is concentric with shaft 75 to keep the shaft unexposed for any elevation of structure 85.

Figure 8:
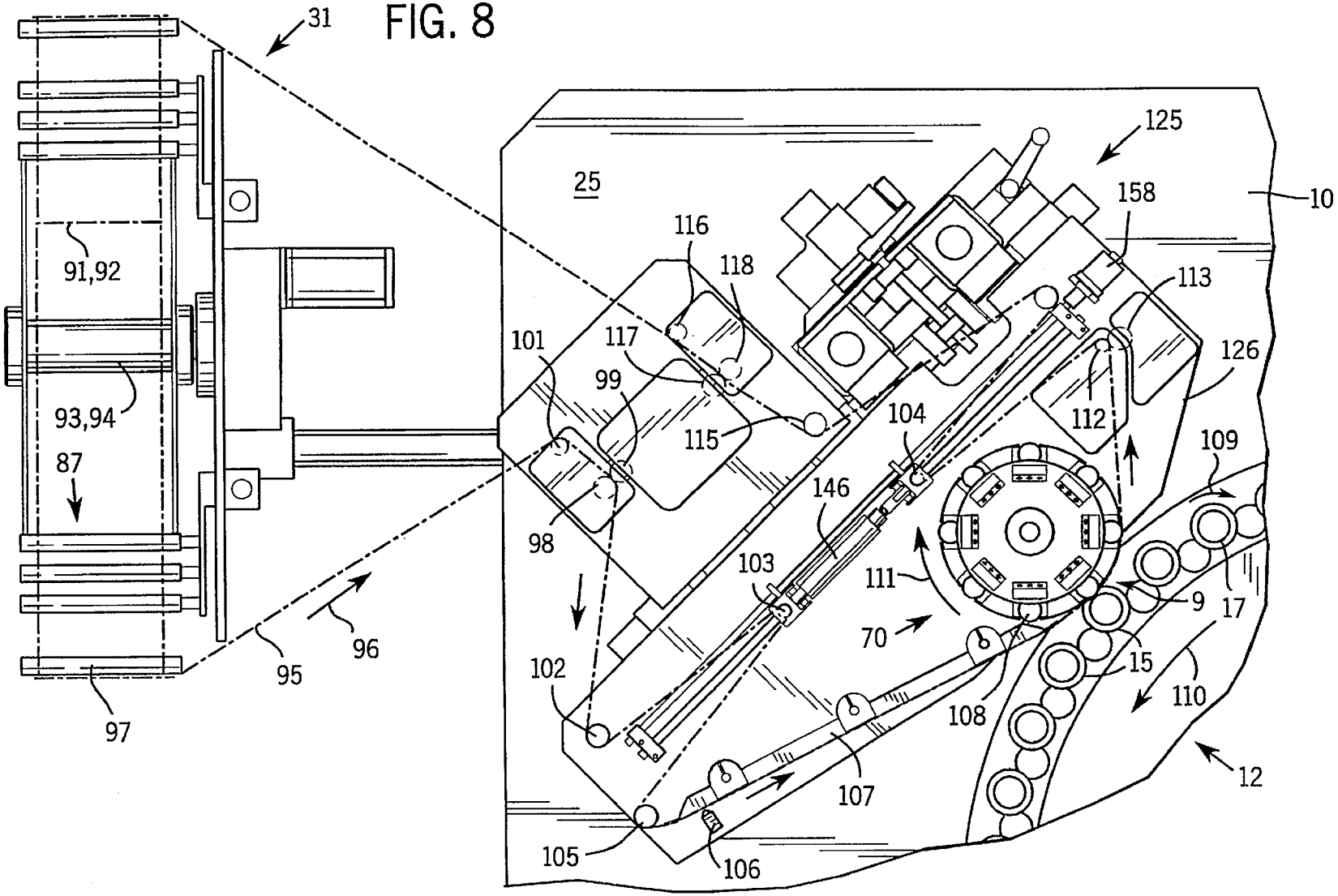
FIG. 8 is a plan view of one of the transfer units of the machine.

Attention is now invited to FIG. 8 to initiate a more detailed description of the new thermal ink graphic transfer unit and the web control system it incorporates. Any unit 25, 26 or 27 depicted in FIG. 1 could be selected for description because they are all the same structurally. In FIG. 8, the unit is identified as unit 25. This unit has web unwind and rewind system 31 associated with it and contains unwind and rewind rolls 91 and 92 which are more easily visualized in FIG. 9 and will be discussed briefly later. The spindles for the rolls are congruent in FIG. 8 so only one spindle 93 appears but the other spindle 94 is beneath it.

In FIG. 8, a web 93 being unwound from an unwind reel through a dancer roll system is moving in the direction of the arrow 96. The graphics, not visible, which are represented with thermally transferable ink are on the side of the web where the lead line from numeral 95 touches the web. It is this side that will ultimately bear on the periphery of a container 15 in the ink transfer station 9. The web may be comprised of a paper-like substrate which has a release coating on it that is compatible with the ink graphics which are printed in negative or reverse form on the release coating and are transferable to an object such as a glass, plastic or metal container when subjected to heat and pressure. A suitable web material is obtainable from Avery Dennison Manufacturing Company of Framingham, Mass. as well as other manufacturers. It is necessary for the container to be hot, usually over 175° C. (350° F.) to get satisfactory transfer. The container preheating oven is not shown nor is the heat curing oven through which the containers pass after they have been decorated to cure the ink. After curing, the ink adheres tenaciously to the containers. It is estimated that despite expected rough handling of returned containers by consumers and others, that the graphics will withstand multiple recycles without significant blemishes.

All of the same type of graphics on any web 95 are ideally uniformly spaced apart or, in other words, the graphics have uniform pitch. The rotational speed of a container depends on the length and pitch of the graphics on the web. There are registration marks 211, not visible on the web except in FIG. 4, that are ideally uniformly spaced apart and are ideally at a uniform distance from the graphics. Errors must be compensated to assure that the graphics make first contact on the container the graphics to be rolled on at exactly the same place on every container passing through the machine. How this is accomplished will be explained in more detail later.

In FIG. 8, the web 95 after unwinding from unwind reel 91 first encounters a direction changing idler pulley 97. A twist is imparted by roll 97 since the web comes off of the unwind reel running horizontally and must go through the machine with the plane of the web oriented vertically. Shortly after roll 97, the web passes between a pair of pinch rolls 98 and 99 which are motor driven web infeed metering rolls. These rolls participate in maintaining equality or balance in the quantity and tension of the web on the infeed unwind side of the thermal ink graphic transfer head 70 and station 9 and on the outfeed or web rewind side of the transfer head and station 9. The rolls 98 and 99 also function to limit inertia in the web transport system. Inertia must be minimized to avoid web breakage and to permit rapid acceleration of the web to make one graphics transfer after another. The structure and function of the metering rolls will be discussed in more detail after the principle components of the thermal ink graphics transfer machine are all identified.

The web advances away from metering rolls 98 and 99 to pass around successive idler rolls 101 and 102 and a roll 103 on a shuttle system which is designated generally by the numeral 100. The function and structure of the shuttle system will be discussed in detail later. After passing around the shuttle roll 103, the web 95 goes around an idler roll 105 and, after passing a detector 106 for a registration mark 211 the web moves along and in contact with an elongated platen 107 with the opposite side from the inked side of the web bearing on the platen. The platen is heated with temperature regulated electric heaters to warm the ink which is necessary for it to be released from the web substrate. The web emerges from the heated platen 107 and passes between a roller 108, of eight identical rollers, on typical transfer head 70 and the periphery of a container at the decorating station 9 which is the place where the graphics or thermal transfer ink images are rolled onto rotary containers 15 in succession.

Figure 5:
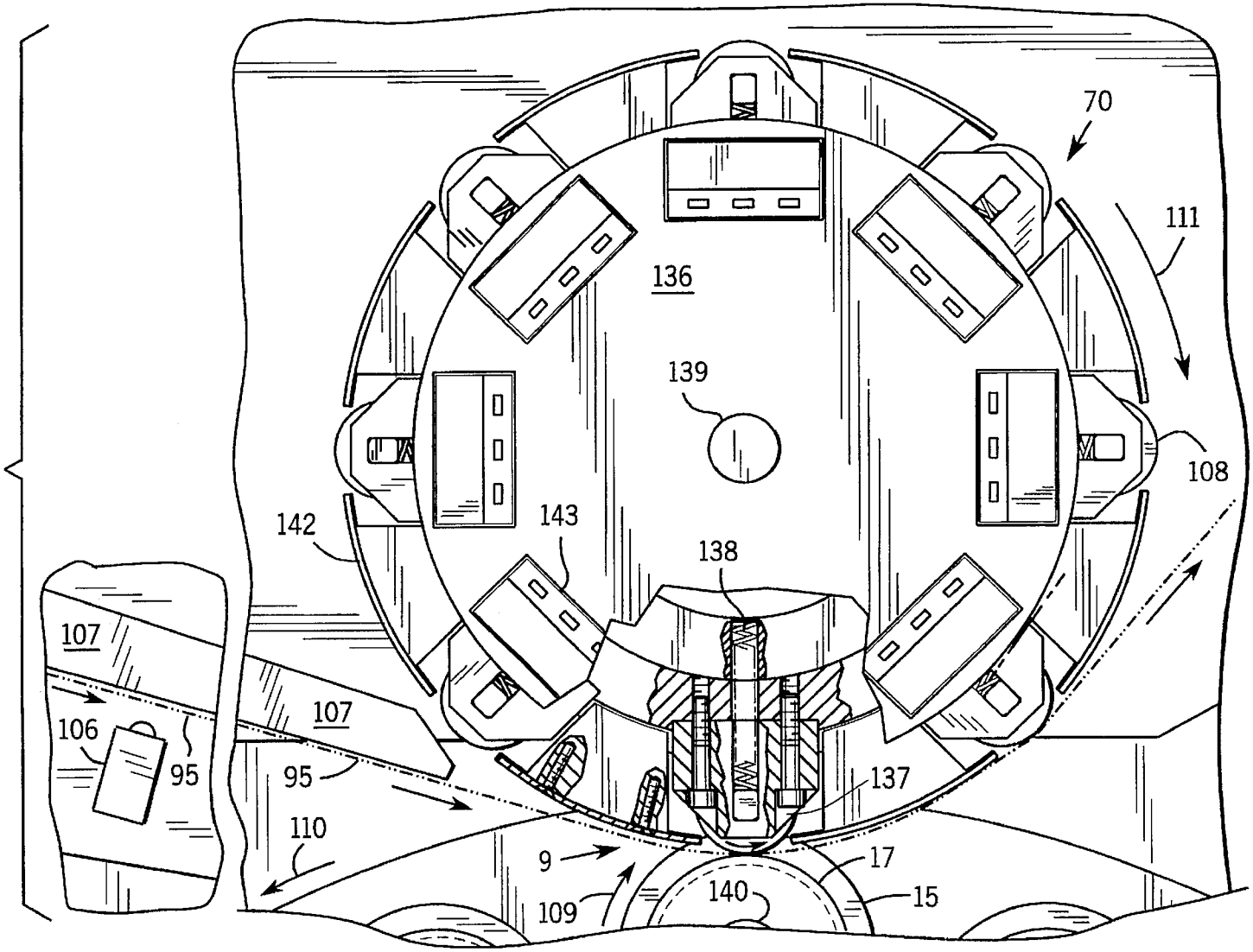
FIG. 5 is a top plan view of the graphics transfer head with a part broken away to show a spring biased roller that is operative to press the web against the periphery of a container on the turntable at the transfer station.

At this juncture it is important to observe, particularly in FIG. 5 the physical relationships of the components of the machine and their translational and rotational characteristics, for it is these relationships, according to the invention, which permit decorating containers at a higher rate than any other relationships and characteristics which are known. Specifically, one should observe that the transfer head 70 is on one side of the web 95 and the turntable 12 and a container 15 are on the opposite side of the web from the transfer head. The rotational axes of the transfer head 70 and the turntable 12 are parallel except in the special case where the transfer head is adjusted to a small angle from vertical for tapered container decorating. The turntable 12 and transfer head 70 rotate in opposite directions but their tangential or linear components of motion at the decorating station where graphic transfer is occurring are the same. The containers 17 on disks 15 rotate in a direction indicated by the arrow 109 while being translated in the opposite direction by the turntable as indicated by the arrow marked 110. The peripheral surface of a container 17 is moving in the same direction as the web 95. In the embodiment shown, the web is moving in a direction opposite of the turntable 13. Under some conditions the web may be required to move in the same direction as the turntable. An example would be where the rotational velocity of the container is less than the rotational velocity of the turntable. What is always true, according to the invention is that the container 17 always rotates in a direction opposite of the rotational direction of the turntable 12 and the transfer head 70 always rotates in a direction that is opposite of the rotational direction of the turntable. The rollers 108 on the transfer cylinder roll in the direction of the web and roll and rotate on the back of the web.

After an ink image is transferred to a container, the now bare web passes between a pair of pinch rollers called capstan rollers 112 and 113. One of these rollers is driven rotationally by a servomotor that is under base plate 10 and is not visible in FIG. 8 but will be discussed later in reference to FIG. 13. It is sufficient to recognize for the moment that the capstan drive system is operative to accelerate or retard the web travel rate to correct any small discrepancy between the position of the graphics entering the decorating station and the position of the container. The capstan system assures that graphics will start to transfer at the identical place on each container. This is important because it assures that if labels or graphics are applied to the front of a container at one place, for example, graphics can be placed exactly diametrically opposite at the back of the container or on the neck of the container if it is a bottle.

After the web transits the capstan rollers 112 and 113, the web goes around another shuttle system roller 104 and then around idler rollers 114, 115 and 116. Then the web passes between pinch rollers 117 and 118 which are web tensioning rollers. One of the rollers 117 or 118 is driven with a differential gear system and a servomotor which are positioned under base plate 10 so they are not visible in FIG. 8 but will be shown and discussed in reference to other FIGURES later.

After leaving the web tensioning rollers 117 and 118, the web goes through a dancer roll system and then passes on to a motor driven rewind reel 92.

A transfer station position adjusting mechanism 125 is mounted to base plate 10. It is conventional and is used in various pre-existing labeling machines, for example. Mechanism 125 acts on bed plate 126 to provide for raising and lowering of the plate and to moving it backward and forward for the transfer cylinder rollers 108 to align with the proper place on a container 15 in the graphic transfer station.

Now that the major components of the machine have been identified the details of the individual components will be considered by way of the different drawings and in conjunction with FIG. 8.

Figure 13:
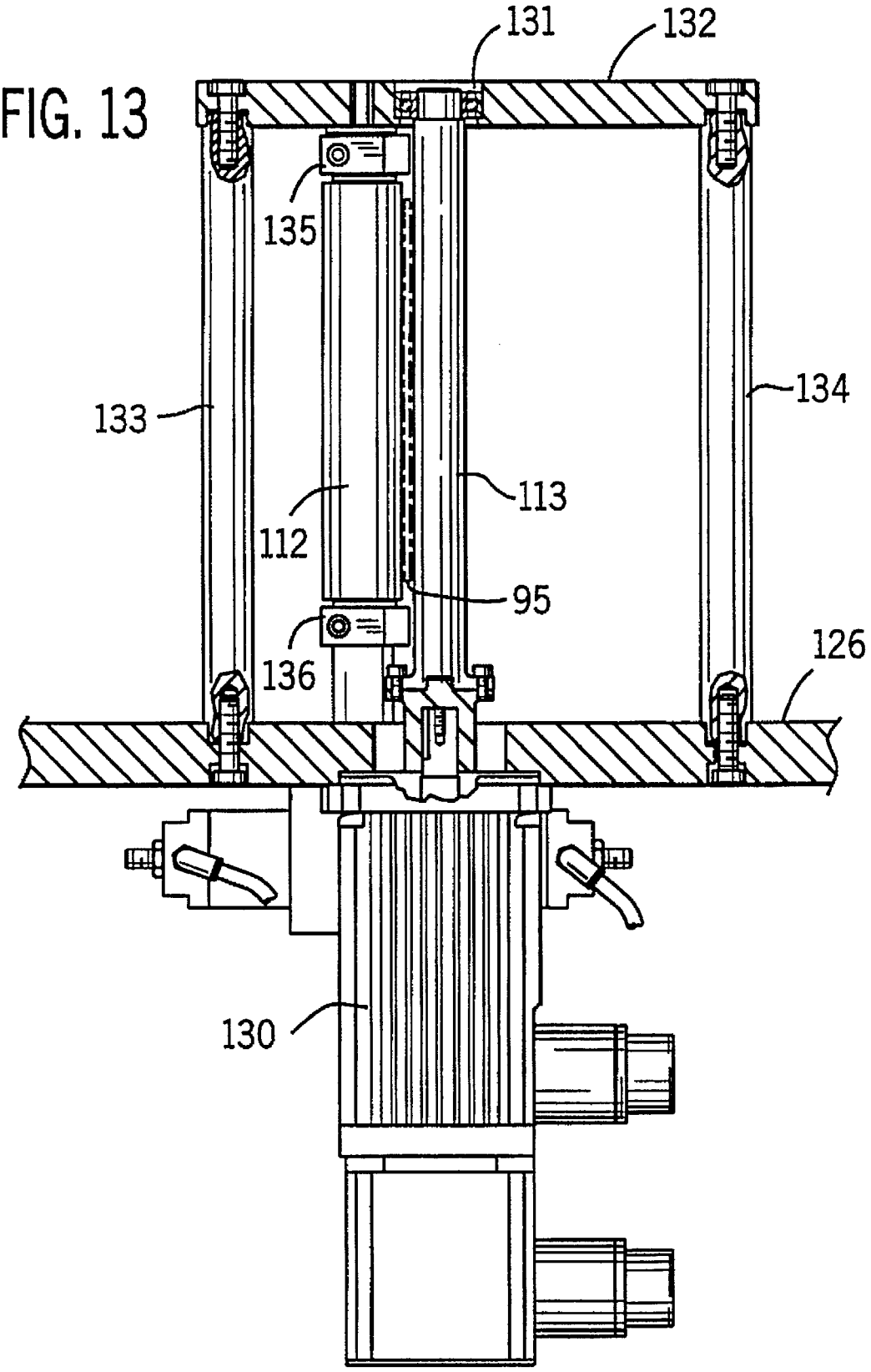
FIG. 13 is a side elevational view of a capstan system including the driving servomotor and pinch rollers.

Refer to FIG. 13 for a discussion of the capstan drive. A servomotor 130 is mounted to the bottom of bed plate 126. Coupled to the shaft of the servomotor is driven roller 113 which was identified in FIG. 8. The upper end of roller 113 has a ball bearing 131 whose outer race is fixed in plate 132 which is supported on posts 133 and 134 of a total of four posts, two of which are not visible in FIG. 13. Either pinch roller 112 is journaled in bearing box 135 and 136. Web 95 is passing between rollers 112 and 113 in FIG. 13 and the web is being pulled by these rollers which are driven by servomotor 130.

As mentioned earlier briefly, the registration mark photodetector 106 in FIG. 8 sends a signal to the programmable controller in console 11 shown in FIG. 1 when the detector cites a graphics location indicating registration mark passing. The controller is always counting clock pulses at a rate of 1,000 counts per pitch, as an example of what is done in an actual embodiment of the machine. An encoder, not shown, produces signals indicative of the instantaneous rotational angle of the turntable and, of course, the position of a container that will be the next to enter the decorating station 9. Knowing where the container is and knowing where the graphic is because of the photodetector signal, the drive signal for servomotor 130 causes the servomotor to run at a speed that results in the leading edge of the graphics of the web to make first contact with a container at the exact place that it should. Because the position of everything involved is relative to a high count rate, in this example 1,000 counts per pitch, graphics precision on the container as good as one part per thousand can be obtained.

Figure 14:
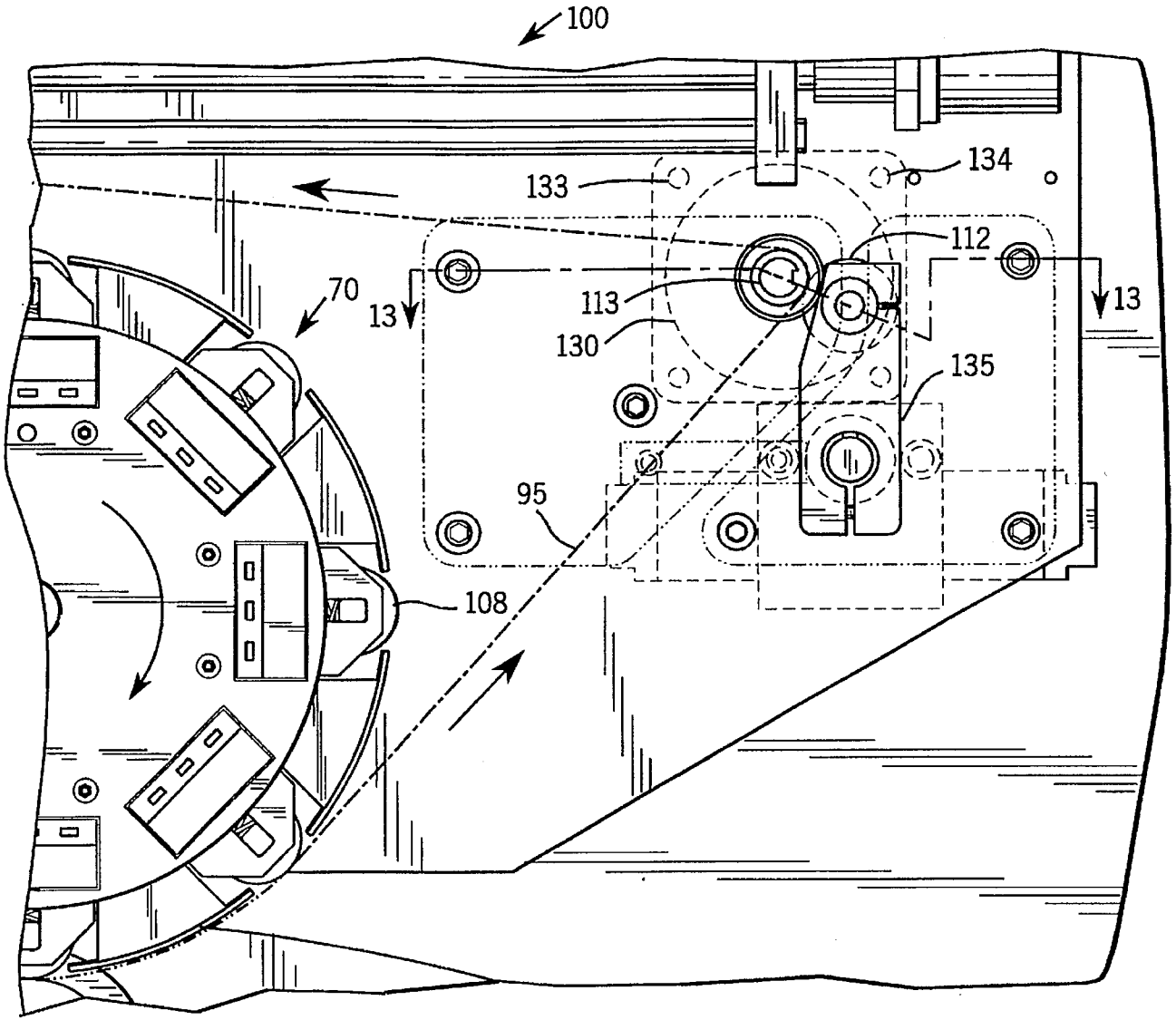
FIG. 14 shows a semi-portion of the graphics transfer head in conjunction with the capstan rollers and the capstan roller drive servomotor which is shown in dashed lines.

FIG. 14 shows a plan view of the capstan drive including rollers 113 and 112. Roller 112 is on a swingable pressure bar 137. In FIG. 14, one may see that the web 95 is departing from the transfer head 70 and is passing through the capstan rolls on its way to the metering system which is shown in FIG. 11 and will be discussed in more detail later.

A section through a transfer head 70 is shown in FIG. 5. The rotor of the head itself is marked 136. In this particular embodiment, there are eight roller assemblies including previously mentioned rollers 108. One roller is presently traversing the transfer station 9 and is in contact with the backside of the web which is being pressed by roller 108 against the periphery of a container 15 which is on its support disk 17 and is rotating counterclockwise as viewed from the top and oppositely of the transfer head 70 as a whole. It will be evident that the graphics are not simply pressed on the container but are rolled on. The rollers are on carriages such as the one marked 137 and are slidable and pressed toward the container by a spring 138. Thus the rollers can retract and advance to maintain contact with the periphery of the container after the transfer head passes the radial line on which the axis of roller 137 the axis of transfer head shaft 139 and the support disk shaft 140 are coincident with the same straight line. It will be evident also that the roller 108 has to be advanced radially outwardly to meet the oppositely translating container 15 as the container enters the transfer station area 9. The transfer head is provided with a plurality of housings 141 in which there are electric heater elements, not shown, for heating curved metal 142 which span between rollers 108. Each of the heating element assemblies in housings 141 are associated with temperature controllers 143 that maintain the temperature of the segments 142 very close to a specified temperature over the entire axial length of the segments and, hence, over the entire width of the web as the web is kept hot by the segments as long as possible before the rollers 108 become active to press the web against the container 15 periphery. Each heater element in the housing 141 has an individual temperature controller.

Figure 15:
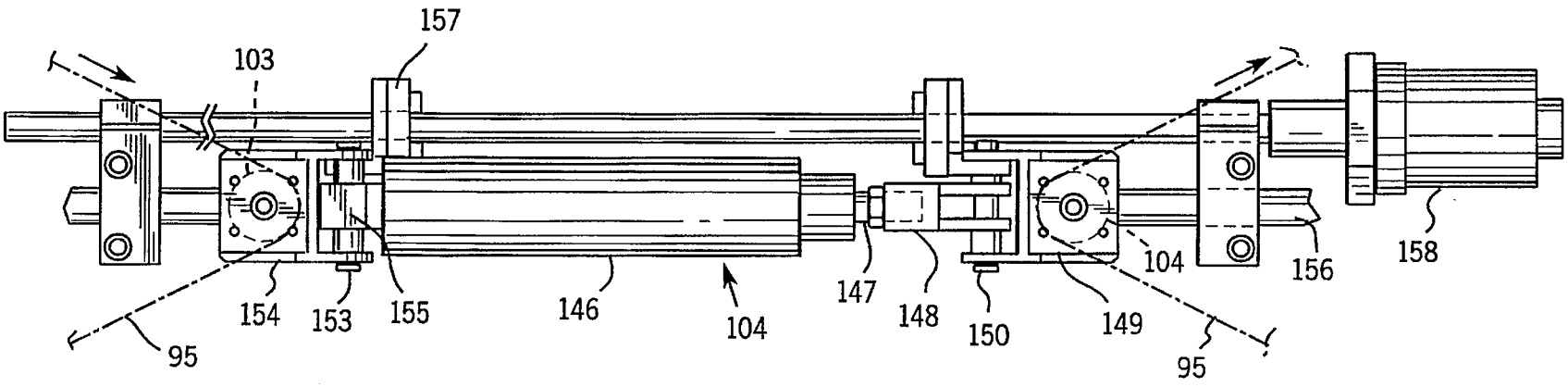
FIG. 15 depicts a shuttle system including an air cylinder that is utilized for maintaining web tension equality on the input and output sides of the transfer head.

The shuttle assembly 104 is shown enlarged in FIG. 15. The shuttle device consists of commercially available components. The shuttle is comprised of an air cylinder 146 which contains a piston, not visible. A piston rod 147 is attached to the piston and has a clevis 148 attached to it. The clevis connects the piston to a carriage 149 by way of a pin 150. A bracket 151 extends from carriage 149 and contributes to guiding the carriage on a magnetizable rod 152. There is air under pressure in the cylinder on one side of the piston. This pressure is held very constant and is regulated closely. Cylinder 146 is coupled by way of a pin 153 passing through suitable holes in a roller carriage 154 and a protuberance 155 which is fixed to the cylinder 146. The carriages 149 and 154 are slidable on and guided by a fixed rod 156. A bracket 157 extends from carriage 154 and is slidable on rod 152 with carriage 151 but the carriages can move independently of each other since one is connected to the piston rod and the other is connected to the cylinder. The positions of the carriage are sensed with a sensor device 158 using magnetostriction phenomena. The output signal of sensor 158 represents the time interval between initiation of an interrogation pulse and detecting a return of the pulse along rod 152. The interrogation pulse is generated by the sensor's electronics and travels at the speed of light. A pulse or physical strain travels back to the sensor 158. Some magnetic fields interact and are processed by the electronics, not shown, and they yield a signal indicative of the distance by which the brackets 151 and 157 are separated which is equivalent to the distance by which rollers 103 and 104 are separated. In an actual machine, a Temposonics LH position sensor 158 is used but other methods for sensing the relative positions of the rollers 103 and 104 such as deriving signals from potentiometers, not shown, could be used.

Figure 10:
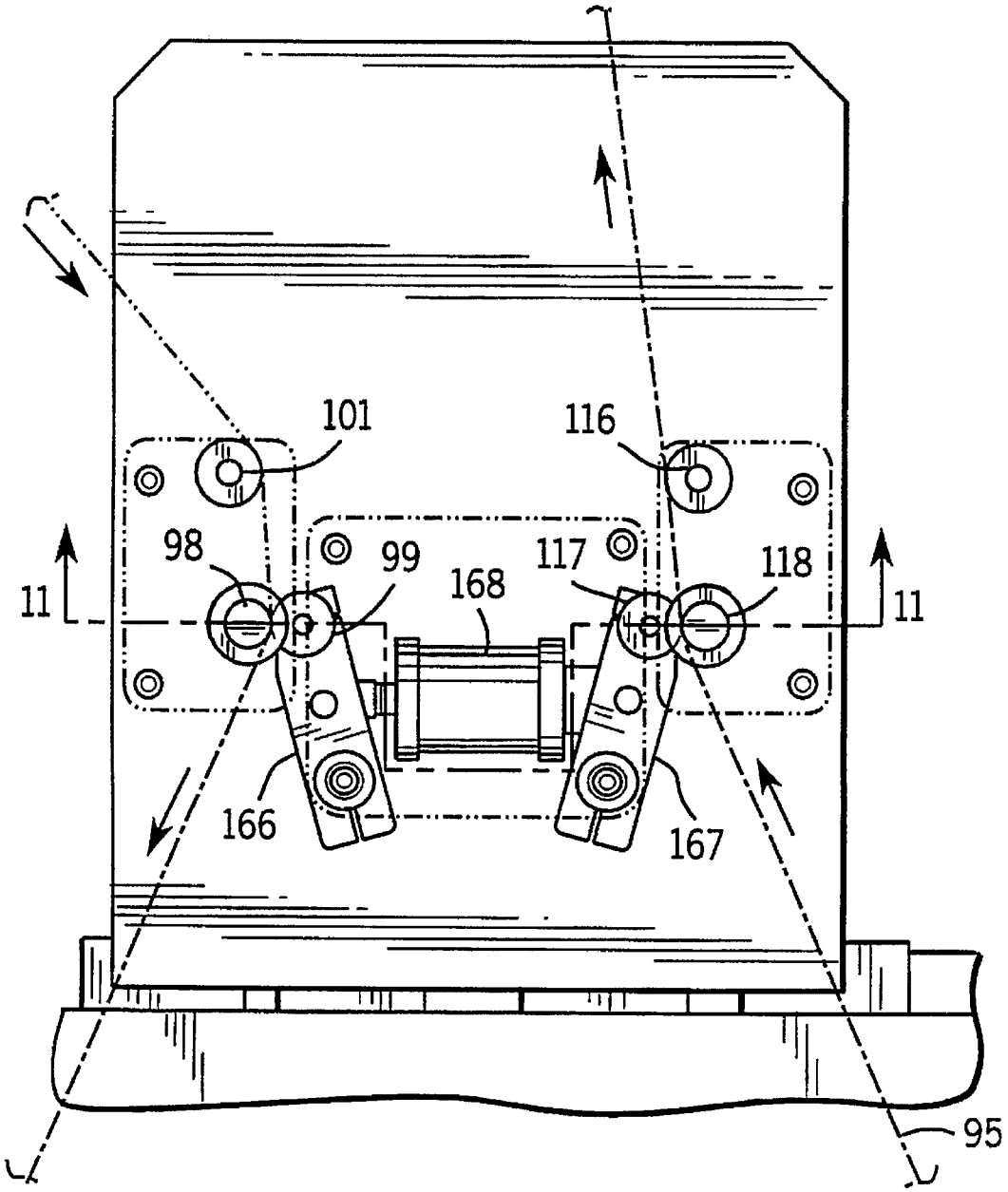
FIG. 10 is a view of the pairs of metering rollers showing how the rollers are biased relative to each other by using a pneumatic cylinder.
Figure 11:
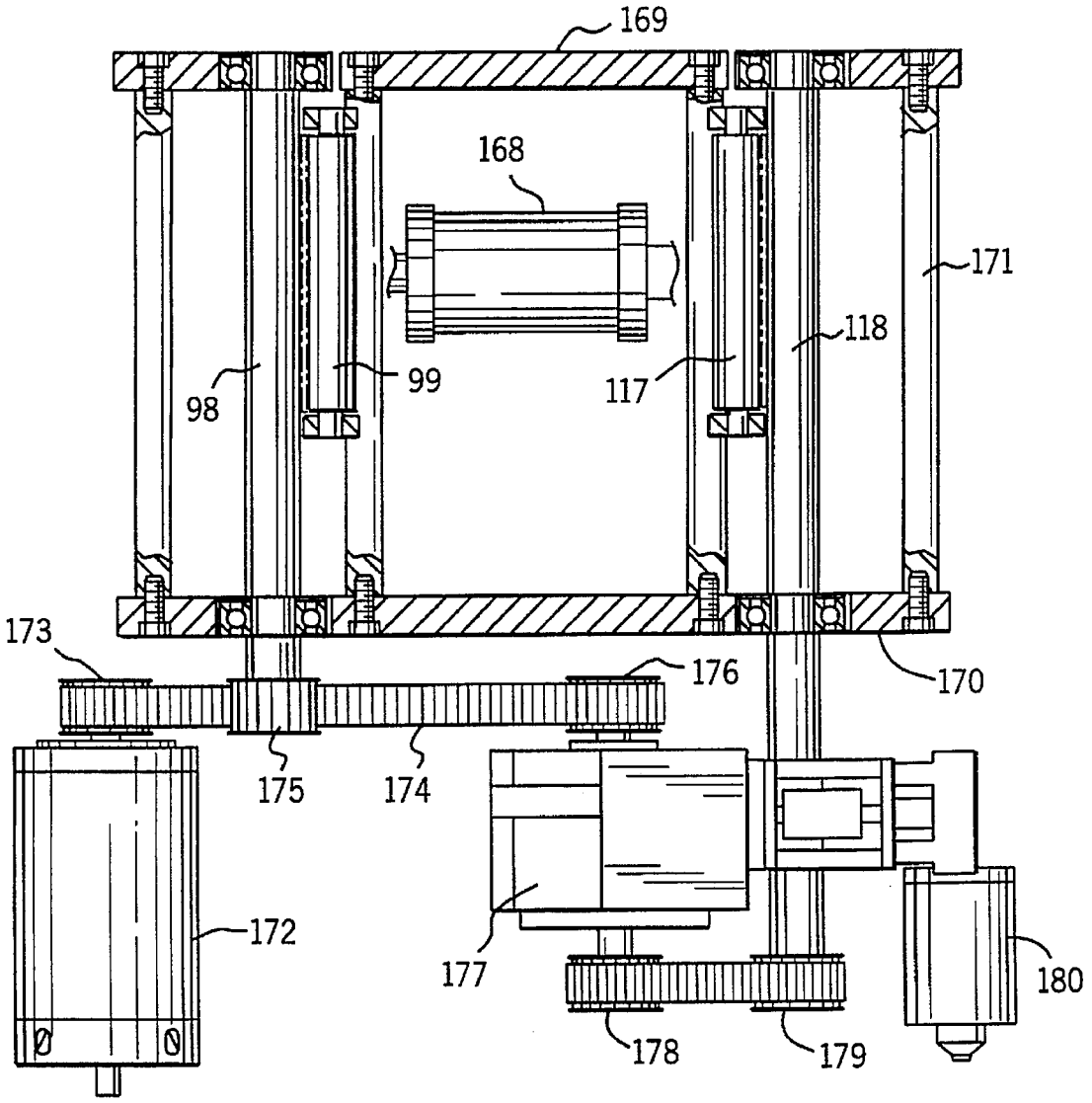
FIG. 11 is a side elevational view of the metering rolls and driver components.

The metering roll system is illustrated in FIGS. 10 and 11. The metering roll pairs 98, 99 and 117, 118 were previously identified in connection with FIG. 8. These pinch rolls are shown in FIG. 10 as well. In FIG. 10 one may see that the pinch rolls 99 and 117 are pressed toward the driven rolls 98 and 118, respectfully, on pivotal arms 166 and 167 and which are biased by a pneumatic cylinder 168.

The overall metering roll system is depicted in FIG. 11. The driven metering rolls 98 and 118 are rotated in ball bearings that are mounted in plates 169 and 170. The plates are maintained in parallelism with posts, one of which is identified by the numeral 171. The main electric metering motor is marked 172. A toothed pulley on the shaft of this motor is marked 173. Toothed pulley 173 drives a toothed belt 174 which engages with a pulley 175 that drives roller 108 rotationally. The belt also engages a toothed pulley 176 on the shaft of a differential device 177. The differential has a pulley 178 on its shaft and there is a comparable toothed pulley 179 on roller 118. A motor 180, called the tensioning motor, drives differential 177.

Figure 4:
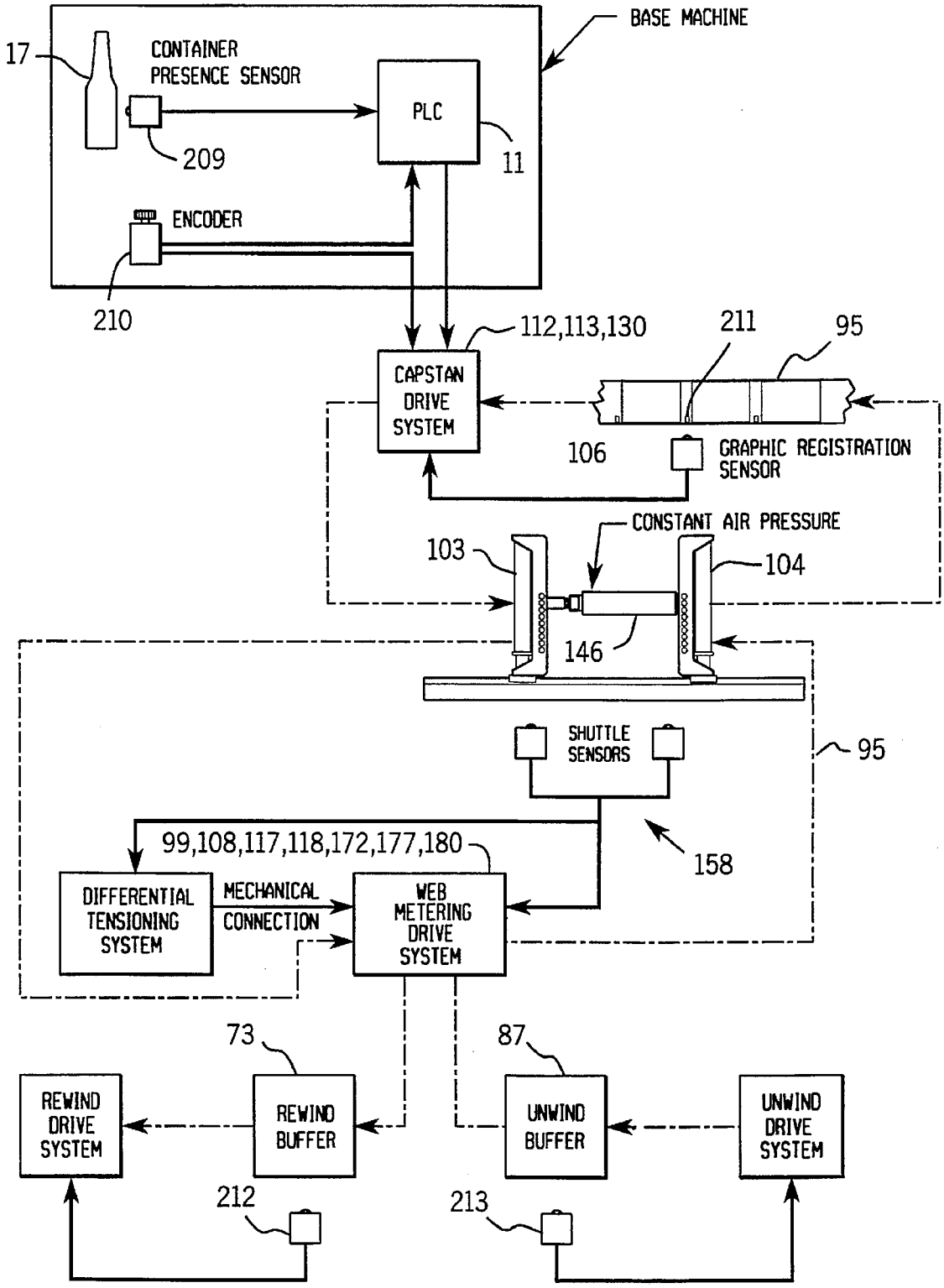
FIG. 4 is a diagram that is useful for explaining the functional aspects of the thermal ink transfer decorating machine.
Figure 9:
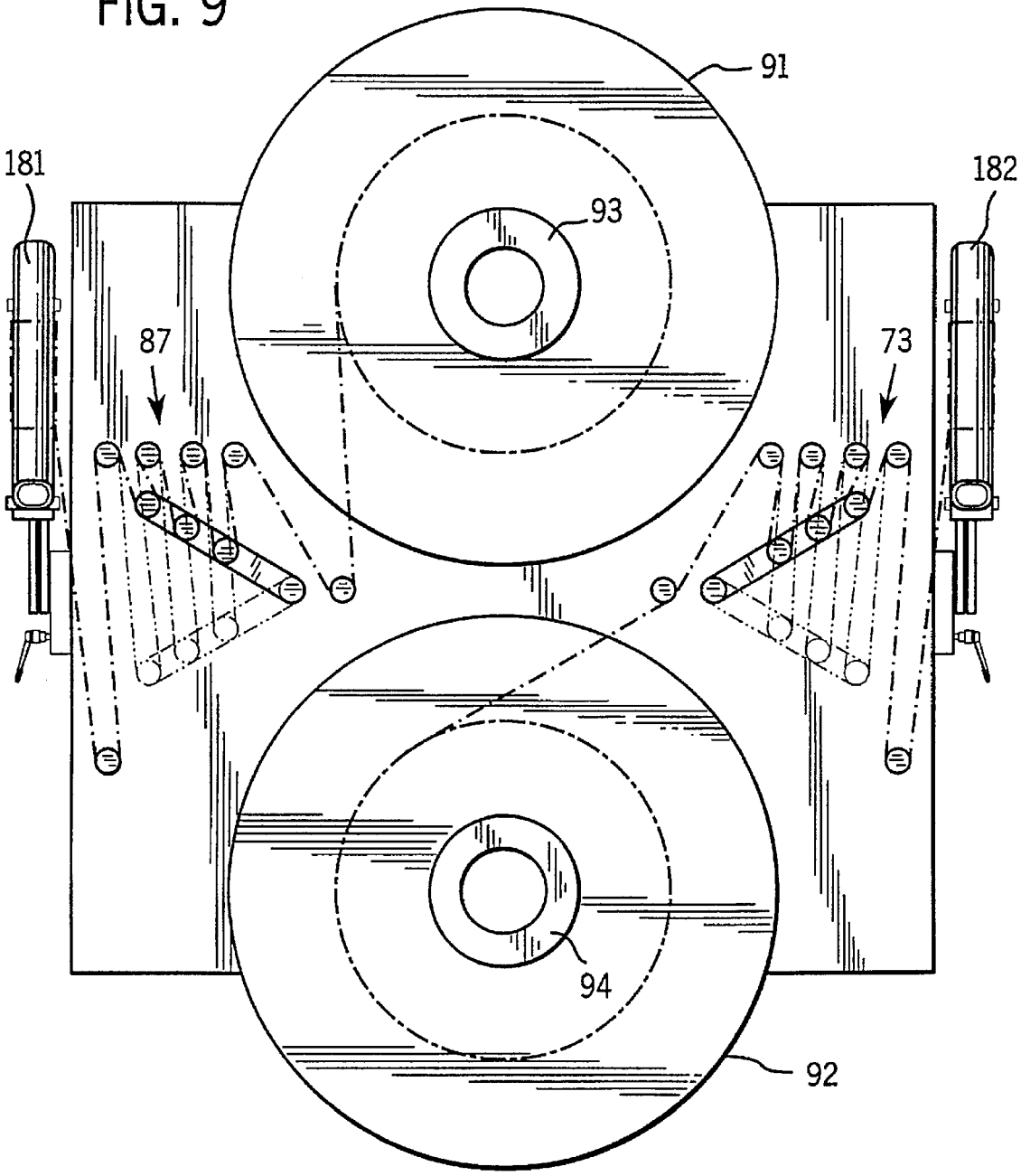
FIG. 9 depicts a web unwind reel and a web rewind reel in conjunction with their diagrammatically illustrated web storage dancer systems.

The conventional unwind and rewind reel systems are depicted in FIG. 9. Each is provided with a dancer roll system that is familiar to those involved in the labeling art as a way to store a length of web at the input or output to a roll so that if web is drawn rapidly, it can be paid out from storage by the dancer system when needed. There are motors, not shown, for driving the unwind reel 91 and the rewind reel 92. The sensors, that monitor the storage condition of the dancer systems 73 and 87 are not shown but are represented in FIG. 4. Since the rolls 91 and 92 rotate about horizontal axes, it is necessary to impart a twist in the web for the web to pass through the machine from infeed to outfeed by means of rolls marked 181 and 182 in FIG. 9.

Figure 12:
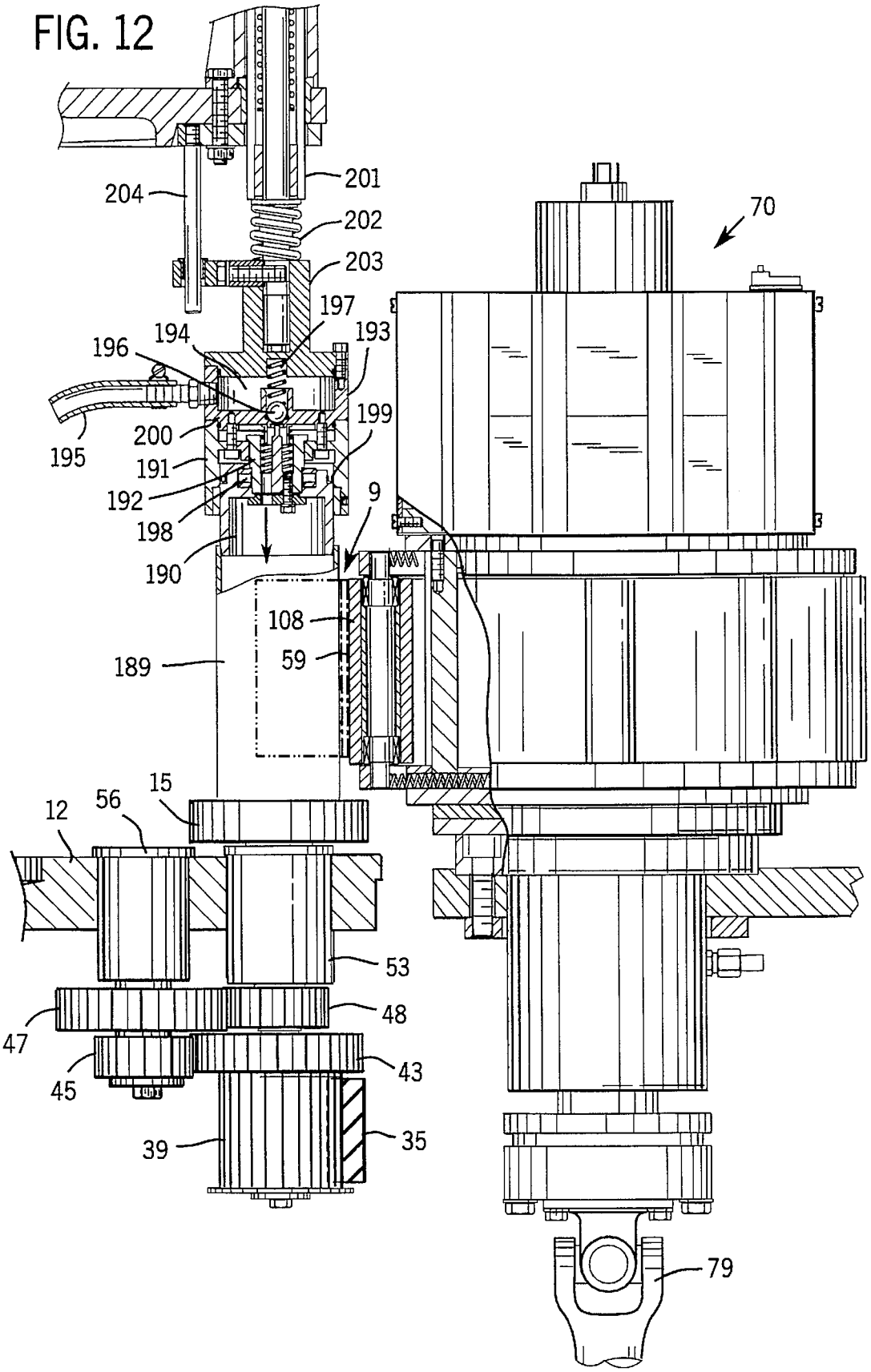
FIG. 12 is a side elevational view of a transferring head, partially in section, in conjunction with a centering bell that is adapted for pressurizing the interior of a thin wall can while it is being decorated at the decorating station.

FIG. 12 shows a special centering head that is used when thin wall cans are being decorated. In such cases the can 189 must be pressurized interiorly or its sidewall will collapse under the force of spring biased roller 108 during the graphics transferring step. Before the can 189 arrives at transfer station 9, a hollow piston 190 is pressed onto the top of the can out of a cylinder 191. When the piston 190 is pressed onto the top of the can, it moves a plunger 192 upwardly. Cylinder 191 is fastened to a cylindrical air chamber 193. Air chamber 193 provides a pressurized plenum 194 to which an air supply hose 195 is connected. Cylinder 193 has a valve seat under a valve ball 196. When the piston is not engaged with a can, the valve is biased toward closed position by a spring 197. When the can is engaged, plunger 192 raises valve 196 from its seat to allow air to flow into the can. In an actual machine, the air pressure was chosen to be 40 psi. When the can is engaged, piston 190 is able to turn in a needle bearing 198 at high speed. In an actual machine, byway of example and not limitation, the piston rotates at a speed of about two revolutions per pitch for a commonly used bottle size. It must rotate at high speed in order to be coordinated with the previously mentioned innovative relationship between the rotational direction of the turntable, the rotational direction of the containers on the turntable, the translational direction of the web, and the rotational direction of the graphics transfer head which, according to the invention, are related to obtain ideally high container decorating rates. Suitable seals are provided to prevent air leaks. The piston rotates in a seal having a U shaped cross section and which is marked 199. There is another seal 200 between the cylinder 191 and cylindrical chamber 193. The whole pressure head is driven downwardly with a ram 201 whose downward force is limited by interposing a spring 202 between the ram and the cap 203 of the combination centering bell and pressurizing assembly. The cap 203 is maintained in accurate vertical alignment with a guide rod 204.

Operation of the machine will now be summarized in reference to FIGS. 4 and 8, particularly. In FIG. 4, the first thing that happens is for a sensor 209 to sense the presence of a container entering the machine. The sensor provides a signal to programmable controller (PLC) 11 that a container is present. The PLC knows where the container is because it has data referencing to the turntable angular position and to the container pitch in the turntable. The PLC 11 is counting clock pulses continuously at a rate of 1,000 per pitch, by way of example and not limitation. An encoder 210 makes one revolution per container pitch and provides this information by way of a signal to the PLC for the PLC to be able to interpret container position in terms of clock pulses.

The capstan rollers 112 and 113 actually pull web through the image transfer station 9. The capstan drive system comprises rollers 112, 113 and servomotor 130. The capstan drive system has the responsibility of assuring that the graphics on web 95 will begin to roll on every container at the transfer station at precisely the same position on every container. The graphics registration sensor 106 determines the position of the incoming graphics by detecting a registration mark 211 which is at a known distance from the next thermal ink transfer graphics on the web. This information is signaled to the capstan drive which can now determine if the graphic is too far advanced or retarded relative to the position of the container for precise positioning of the graphic on the container.

The capstan drive system is controlled to change its drive speed in an anticipatory fashion, that is, the capstan servomotor 130's speed must be modified in advance of the time that the transfer of the graphic should begin. So the capstan system pulls web in a direction away from metering rolls 98 and 99 to get the graphic and the place on the container where the graphic should be applied to coincide.

Since web has been drawn out of the infeed side of the transfer station 9 and web has been yielded to the rewind side of the transfer head, tension force exerted by the web to the shuttle shifts the shuttle to the left in FIG. 8. The shuttle roller 104 is on a carriage that connects to the shuttle piston rod 147 which extends from the invisible piston in shuttle cylinder 146. Constant air pressure on the piston results in the web tension being maintained constant provided the piston is never allowed to bottom out. However, the shuttle has shifted which means that the amount of web on opposite sides of the transfer station 9 must be equalized. As mentioned earlier, separation of shuttle rollers 103 and 104 is determined for enabling determination of the shuttle piston position. FIG. 4 shows two shuttle sensors which are collectively indicated by the numeral 158 since the magnetostrictive sensing system is bidirectional.

Preventing the piston in cylinder 146 from bottoming out is accomplished with a differential drive in the web metering system. This system includes the rollers 99, 108, 117, 118, metering motor 172, differential drive 177 and tensioning motor 180. If no correction in piston position in shuttle cylinder 146 is necessary, the metering drive system allows the same amount of web into the shuttle as it takes out. If correction is required, the tensioning motor 180 drives the differential 177 in the proper direction either to add or take away web to center the piston. This actually happens while the metering system is supplying web and decorating is taking place. Thus, web tension is adjustable but accurately controllable.

Continuing with the description of machine operation in reference to FIG. 4, the rewind buffer 73 and 87 are identified and correspond to the dancer systems which were previously mentioned. The amount of web in storage between the unwind reel and metering rollers 98 and 99 and from the rewind roll to metering rollers 117 and 118 is determined with optical detectors 212 and 213. These detectors signal the rewind drive system, and particularly the motor that drives the reels, to effect taking in some of the stored web and the unwind buffer 87 does the same thing except that it controls the unwind drive system motor.

I claim:

1. Apparatus for transferring thermal ink graphics from a web to containers, comprising:

a turntable continuously driven rotationally about a vertical axis in one direction of rotation, a plurality of container supports arranged on said turntable in equiangularily spaced apart relationship concentric to the turntable axis, and means for driving said container supports continuously with containers thereon, respectively, in a direction of rotation opposite from said direction of rotation of the turntable, a web having transferable thermal ink graphics on one side thereof translating through a transfer station concurrently with a rotating container with said one side of the web in contact with said container and the web moving in the same direction as the periphery of said container, a graphics transfer turret comprised of a plurality of equiangularly spaced apart rollers, arranged at a side of the web opposite of the side of the web that contacts the container for acting on said web to transfer said graphics to said container, said transfer turret rotating about an axis that is substantially parallel to the axis of said turntable and with said spaced apart rollers not concentric with said turntable in a direction opposite of the rotational direction of said turntable.

2. Apparatus for transferring thermal ink graphics from a web to containers, comprising:

means for translating said web through a graphics transfer station, said web having a back side and a front side with said graphics on said front side, a turntable driven continuously or rotating about a vertical axis in a selected direction of rotation, a plurality of continuously rotationally driven container support members arranged in uniform circumferentially spaced apart relationship in a circle concentrically of said axis of the turntable for presenting containers on said support members to the front side of said web while the containers undergo rotation as they transit said transfer station with a direction of rotation opposite of the direction of turntable rotation, a generally cylindrical transfer turret continuously driven rotationally about a substantially vertical axis that is parallel to said axis of the turntable adjacent said back side of said web at said transfer station, said transfer turret having a plurality of rollers arranged equiangularly spaced apart in a circle that is concentric to the axis of said turret but is not concentric to said axis of the turntable for pressing against the back side of the web to effect transfer of graphics from said web to a rotating container transiting said transfer station while said web is interposed between said container and said transfer turret and said web is translating in the same direction as the direction in which the periphery of the container is moving and said transfer turret is rotating in a direction opposite from the rotational direction of said turntable.

3. A machine for transferring thermal ink graphics from a web that has a back side and a front side on which there are graphics and said web is moving in a predetermined direction, comprising:

a turntable continuously driven rotationally about a vertical axis and positioned at said front side of said web and the turntable is rotating in one direction, a generally cylindrical transfer turret driven rotationally continuously about a vertical axis at said back side of the web, said transfer turret rotating in a direction opposite of the direction of rotation of the turntable about an axis that is parallel to said axis of the turntable, said transfer turret having a plurality of rollers arranged equiangularly spaced apart in a circle that is concentric to the axis of said turret, a plurality of container support members arranged in uniform circumferentially spaced apart relationship in a circle that is concentric to the axis of the turret but not concentric to said circle on said turret about which said rollers are arranged, on said turntable, the support members are driven rotationally continuously in an opposite direction of rotation from the rotation of the turntable for respective containers on said support to also rotate in said opposite direction, said web passing between a rotating container on said turntable and said transfer head for said head to press against said back side of said web to transfer graphics on the front side of the web to the containers with said web moving in said predetermined direction which is the same as the direction in which the periphery of said container moves.

4. A machine for transferring thermal ink graphics from a web that has a back side and a front side on which there are graphics and said web is moving in a predetermined direction, comprising:

a turntable driven rotationally continuously about a vertical axis and positioned at said front side of said web and the turntable is rotating in one direction, a generally cylindrical transfer turret driven rotationally continuously about a vertical axis at said back side of the web, said transfer turret rotating in a direction opposite of the direction of rotation of the turntable about an axis that is parallel to said axis of the turntable, said transfer turret having a plurality of rollers arranged equiangularly spaced apart and concentric to said axis of the turntable, a plurality of container support members arranged uniformly circumferentially spaced apart on said turntable, about the axis of the turntable and not concentric with said rollers, the support members are driven rotationally continuously in an opposite direction of rotation from the rotation of the turntable for respective containers on said support members to also rotate in said opposite direction, said web passing between a rotating container on said turntable and said transfer turret for said rollers to press against said back side of said web to transfer graphics on the front side of the web to the containers with said web moving in said predetermined direction.

* * * * *